US005362524A

United States Patent [19]

Dutta et al.

[11] Patent Number: 5,362,524

[45] Date of Patent: Nov. 8, 1994

[54] METHOD FOR COATING ASYMMETRIC GLASS ENVELOPE FOR LAMP BY ELECTROSTATIC COATING

[75] Inventors: Arunava Dutta, Chestnut Hill; Mark A. Morrison, Ipswich; Leonard V. Dullea, Peabody; Richard A. Kingston, Beverly; Joseph A. Olsen, Rockport, all of Mass.

[73] Assignee: GTE Products Corporation, Danvers, Mass.

[21] Appl. No.: 998,086

[22] Filed: Dec. 29, 1992

[51] Int. Cl.[5] ..... B05D 1/06; B05D 7/22

[52] U.S. Cl. ..... 427/476; 427/67; 427/475

[58] Field of Search ..... 427/476, 475, 67

[56] References Cited

U.S. PATENT DOCUMENTS 4,597,984 7/1986 Jansma ..... 427/28

4,914,723 4/1990 Ellerbeck et al. ..... 427/67

OTHER PUBLICATIONS

Powder Coating Technology, J. F. Hughes, Journal of Electrostatics, 23, (1989), 3–23.

Glass Engineering Handbook, 3rd Edition, George W. McLellan & E. B. Shand, (1984), 2–36 to 2–39.

*Primary Examiner*—Asok Pal

*Attorney, Agent, or Firm*—Carlo S. Bessone

[57] ABSTRACT

A method for providing an electric field having a desirable configuration and strength for the electrostatic coating of phosphors on a fluorescent glass envelope at a controlled temperature comprising enclosing a fluorescent glass envelope with at least one electrically conductive charge retaining member at a desired temperature for the duration of the actual electrostatic coating operation wherein charged phosphor particles are attracted to the interior of the glass envelope and the charge is dissipated to the charge retaining member which remains substantially electrically isolated during the coating process. The process is most suitable adapted to an asymmetric fluorescent glass envelope.

29 Claims, 2 Drawing Sheets

METHOD FOR COATING ASYMMETRIC GLASS ENVELOPE FOR LAMP BY ELECTROSTATIC COATING

FIELD OF THE INVENTION

This invention relates to fluorescent lamps and more particularly to a method and apparatus for coating a fluorescent lamp glass.

BACKGROUND INFORMATION

Electrostatic coating of phosphors on glass substrates, for the ultimate purpose of lamp making, is discussed in the patent literature. Both bulbous and linear glass shapes have been coated by this method. Electrostatic coating processes are characterized by the following key steps: (1) feeding of powder to a carrier gas stream; (2) transport of the powder laden gas to a high voltage probe; (3) charging of the powder in the corona surrounding the probe; (4) transporting the charged powder particles in the carrier gas stream to the vicinity of a substrate maintained at a suitable temperature preferably above ambient, and at an electrical potential suitably different from the probe potential thereby creating an electric field such that the charged particles may migrate, under the action of this electric field, towards the substrate; (5) depositing the charged particles on the substrate; (6) thermally treating the coated substrate to bind the coating to the substrate.

This invention advances the state-of-the-art in electrostatic coating by making improvements in step (4). In particular, this disclosure describes a means for providing an optimum electric field configuration and strength for the electrostatic coating of phosphors on asymmetrical glass substrates in general, and compact fluorescent lamp glass in particular, while maintaining the temperature of the glass substrate within an optimum range by means of conformal heating.

The configuration of the electric field around a glass substrate controls the distribution of the coating and the overall extent of surface coverage of the substrate. The electric field strength influences the time scale of radial motion of the charged particles to the substrate relative to the time scale of convective axial motion of the particles due to the drag force exerted by the carrier gas. The smaller the radial time scale relative to the axial time scale the shorter is the axial distance traveled by the charged particles after leaving the probe, before they are deposited on the substrate. This promotes quick deposition of the charged phosphor particles soon after they exit the corona region.

In addition, published literature shows that q/m or the charge to mass ratio of a particle is a function of the electric field strength to which the particle is subjected. In particular q/m is proportional to the electric field strength, E, as proven in the Pauthenier Equation [see "Powder Coating Technology" by J. F. Hughes in Journal of Electrostatics, 23, 3 (1989)]. Published literature (ibid.) also indicates that q/m is one of the most important parameters governing the quality of electrostatic coating. A low value of q/m implies poor charging of the powder with subsequent poor adhesion and loss of material due to overspray. The importance of the electric field strength cannot, therefore, be overemphasized.

The temperature of the glass substrate influences its electrical conductivity. In particular, the higher the glass temperature the higher its conductivity. It is worth noting that the change in conductivity with temperature is non-linear. It is necessary that the glass substrate be sufficiently conductive such that the charged particles migrating towards it may induce an opposite polarity mirror charge on the near surface of the glass. This mirror charge is necessary for the initial adhesion of the coating.

Too high a glass conductivity is not, however, desirable. Electrical conductivity in most glasses is ionic in nature, with the sodium ion being responsible for the lion's share of the current. At high temperatures, large amounts of sodium are prone to diffuse out of the glass into the coating. Presence of sodium is detrimental to phosphors in that it leads to lumen losses with time in the finished lamp. There is, therefore, an optimum temperature range for each type of glass substrate. By type, we refer here to the chemical composition of the glass. Glasses which have higher sodium content are more prone to this diffusion problem than glasses with lower contents of alkali. For a large variety of glasses, the logarithm of the resistivity varies linearly with the reciprocal of the absolute temperature. This relation for common fluorescent lamp glass may be approximated by the relation: $\log \rho = -2.1 + 4.44*(1000/T)$ where $\rho$ is the resistivity in Ω.cm and T is the absolute temperature. While $\rho$ changes by about a factor of thirteen between 150° C. and 200° C., the change between 200° C. and 250° C. is about a factor of eight. The mathematical relationship between $\rho$ and T was obtained by linear regression of data presented in Glass Engineering Handbook, 3rd Edition, George W. McLellan and E. B. Shand, McGraw Hill, 1984.

Present methods of electrostatic coating of phosphors on glass substrates are concentrated to bulbous shaped glass typically used for incandescent and high intensity discharge lamps and cylindrical shaped glass used for large linear fluorescent lamps. Examples of recent patents in this field are U.S. Pat. No. 5,032,420 for Cd free yellow incandescent bug lights and U.S. Pat. No. 4,914,723 for a linear fluorescent lamp. It is noted that both bulbous shaped glass for incandescent lamps and cylindrical glass for linear fluorescent lamps are symmetrical shapes which can easily be rotated about their axis. This makes it possible to heat these shapes by a flame without the adverse possibility of softening because the constant rotation of the glass prevents local overheating. Flames are, therefore, the present method of choice in the electrostatic coating of such symmetrical glass shapes. A U-shaped piece of glass like a compact fluorescent lamp glass is, however, asymmetrical. This makes it very difficult to rotate this shape, as a result of which the method of flame heating is rather impractical for compact fluorescent lamp glass.

A flame always contains charged species, and the use of a flame in the electrostatic coating of symmetrical glass shapes also provides an almost zero potential to the glass. For all practical purposes the substrate is, therefore, at ground potential in contrast to the higher (in magnitude) potential associated with the charging probe. This generates the electric field for the migration of the charged phosphor particles to the substrate. In the electrostatic coating of symmetrical glass shapes, therefore, the flame method serves to both heat the glass and provide the electric field. The ability to control the electric field strength using the flame approach is minimal. In addition, unless the flame drapes the glass uniformly, there is a possibility that the control over the configuration of the electric field may also be deficient. Since the use of flames on asymmetrical glass shapes is a problem, neither heating nor electric field generation is practical for asymmetrical glass shapes using the flame approach.

In an alternate approach adopted in the electrostatic coating of phosphors on symmetrical glass shapes, the glass is preheated by some suitable means and rotated about its axis of symmetry while an electrically conductive material touches the exterior of the glass. A metallic brush is frequently used and serves as a path to ground for the charge carried by the phosphor particles to the glass substrate. While this technique provides an electric field, substrate temperature control is not available and the glass temperature is likely to change over the course of the coating cycle. In addition, the control over the configuration and strength of the electric field is barely satisfactory.

It is apparent, therefore, that existing means of generation and control of electric field strength, electric field configuration and substrate heating as applied to the electrostatic coating of asymmetrical glass substrates are deficient. In light of these deficiencies, a new method is proposed whose operation will be clear from the description that follows.

BRIEF SUMMARY OF THE INVENTION

The present invention overcomes the deficiencies of the prior art by providing a means for providing a desirable electric field configuration and strength for the electrostatic coating of phosphors on asymmetrical glass substrates in general, and compact fluorescent lamp glass in particular, while maintaining the temperature of the glass substrate within an optimum range by means of conformal heating.

In accordance with the present invention, there is provided a method for coating electrically charged phosphor particles on an interior surface of a fluorescent glass envelope by providing an electric field having a desirable configuration and strength while limiting electric current and maintaining the temperature of the glass envelope at a temperature conducive for coating, comprising enclosing and contacting at least a portion of a fluorescent glass envelope with at least one electrically conductive charge retaining member, said charge retaining member being maintained at a suitable temperature for coating, issuing a stream of electrically charged phosphor particles into the interior of said glass envelope by transporting said phosphor particles in a carrier gas stream through a high voltage probe generated corona, said electrically conductive charge retaining member being at a different electrical potential than said high voltage probe for attracting said charged phosphor particles to said interior surface of said glass envelope, maintaining contact between said glass envelope and said electrically conductive charge retaining member for dissipating electric charge from said phosphor particles to said charge retaining member, maintaining said electrically conductive charge retaining member substantially electrically isolated wherein electrical charge in or on said member increases during electrostatic coating causing the electric potential of said member to increase whereby electric current associated with the high voltage probe due to said transfer of charge to said charge retaining member is limited, and discharging said electric charge from said member after said coating.

In accordance with preferred embodiments, the charge retaining member comprises at least a pair of charge retaining members having opposing and facing surfaces for substantially enclosing said fluorescent glass envelope and said fluorescent glass envelope has asymmetrically shaped outer surface and each of said opposing surfaces includes a respective depression, each depression substantially matching a portion of said asymmetrically shaped surface for substantially entirely enclosing said fluorescent glass envelope, said opposing surfaces having at least one point for contacting said glass envelope.

DETAILED DESCRIPTION

Figure 2:
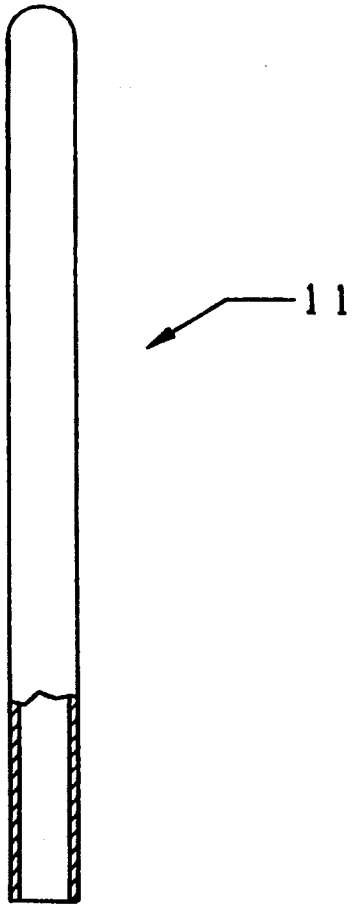
FIG. 2 is an end elevational view of the tube of FIG. 1.
Figure 1:
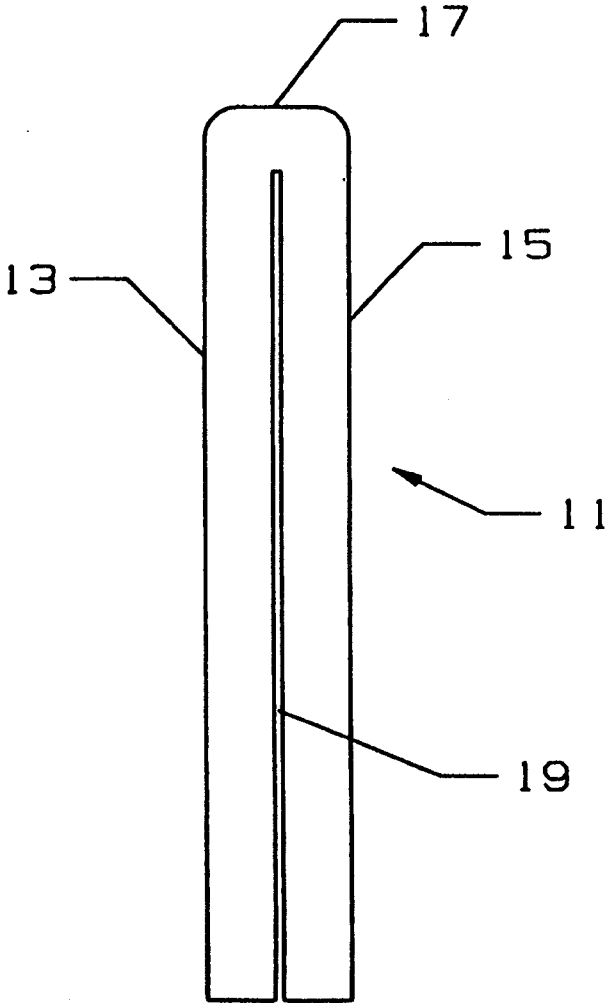
FIG. 1 shows a side view of a glass twin tube used to manufacture compact fluorescent lamps.

With reference to FIG. 1 and FIG. 2, a fluorescent glass envelope 11 is illustrated. The fluorescent glass envelope 11 is asymmetrical and preferably comprises a U-shaped twin tube having leg portions 13 and 15 connected by a bridging portion 17. The glass envelope 11 in the form of a twin tube typically has a narrow space 19 between the leg portions. Hereinafter, the glass envelope 11 may be referred to as a twin tube 11.

Figure 4:
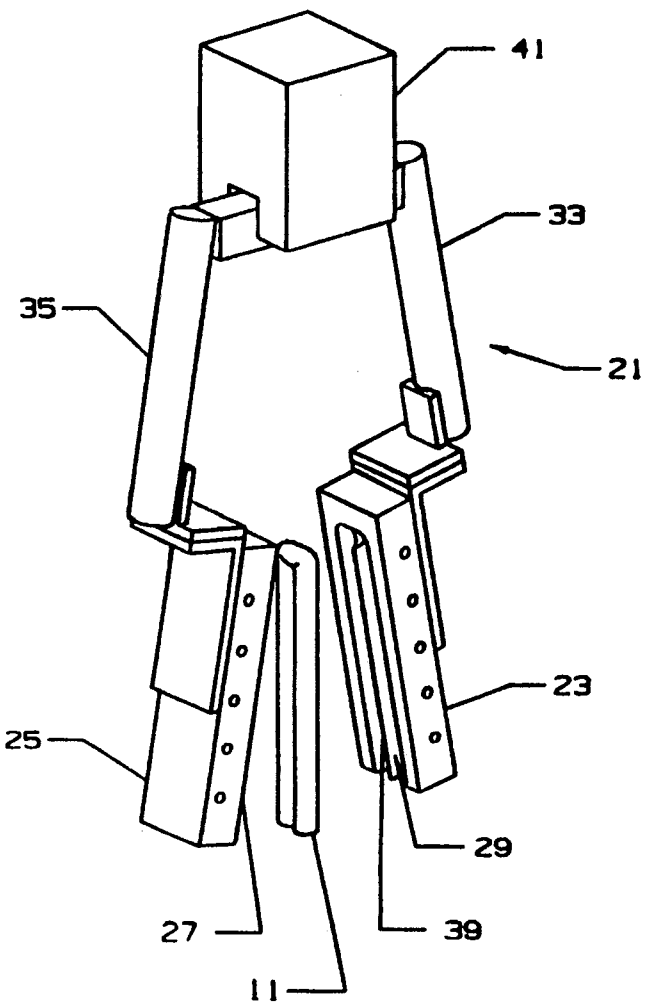
FIG. 4 is a view of the heater and gripper block of the present invention in an open position.
Figure 3:
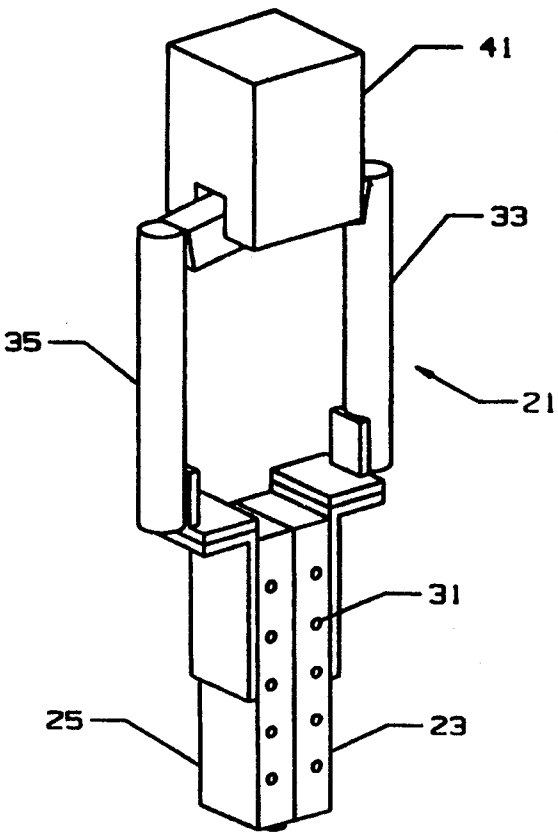
FIG. 3 is a view of the heater and gripper block of the present invention in a closed position.

As illustrated in FIG. 3 and FIG. 4, holder 21 for the glass envelope 11 includes a pair of electrically conductive charge retaining members 23 and 25 preferably comprising a ferrous material. Each of the charge retaining members 23 and 25 includes a respective surface depression 27 and 29 which substantially conform to the shape of the glass envelope 11 for substantially enclosing the glass envelope 11. As illustrated in FIG. 4, the surface depressions 27 and 29 face inwardly toward the axial center of the holder.

The matching surface depressions 27 and 29 are adapted to contact the glass envelope 11 during enclosure so that electric charge on the glass envelope 11 is dissipated to members 23 and 25 during the electrostatic coating process. Otherwise, the members 23 and 25 are electrically isolated during the coating process. As illustrated in FIG. 4, the members 23 and 25 include a raised portion 39 which fits into the narrow space 19 between the leg portions 13 and 15 so as to contact the outside of the lower portion of the bend area or bridging portion 17 of the glass envelope 11. The electrical contact at the bend area assures proper dissipation of the charge from the phosphor particles as the interior of the glass envelope 11 is coated. Physical contact between the glass and the close proximity of the members 23 and 25 directly adjacent the glass envelope help ensure .the maintenance of a desirable electric field.

During the coating operation, an undesirable grounding of the members 23 and 25 may result in an excessive flow of electrical current along a path through the high voltage coating probe, the glass envelope 11, and the members 23 and 25 to ground. Such an overload of electrical current can be damaging to equipment and is a human safety factor. Hence, electrical isolation of the members 23 and 25 during the actual coating operation is desirable. It should be recognized that complex asymmetrical glass envelopes may require multiple coating steps. In this case, it is contemplated that a portion of the envelope is first electrostatically coated, the high voltage coating probe withdrawn, and the charge on members 23 and 25 dissipated by grounding. Another portion of the envelope can be subsequently coated by the same steps.

An electric field having a desirable configuration and strength for the electrostatic coating of phosphors on the interior surface of a fluorescent glass envelope 11 is created by the utilization of charge retaining members 23 and 25. During electrostatic coating operation, highly charged phosphor particles which issue from a high voltage probe that is inserted into the interior of the glass envelope 11 are attracted to the interior surface of the glass envelope 11 which has an electrical potential lower in magnitude than the probe. To achieve an adherent coating of phosphor, the electrical potential between the glass envelope 11 and the high voltage probe is maintained at a sufficiently high differential so that charge to mass ratio of the phosphor particles is at a desirably high level. Due to the presence of contact points between the members 23 and 25 and the glass envelope 11, any tendency for an electrostatic charge to build up on the interior of the glass is dissipated to the members 23 and 25 so that the electric potential of the glass is maintained at a sufficiently low level which is conducive to produce an adherent phosphor coating.

During the actual electrostatic coating process, the members 23 and 25, except for contact with the glass envelope 11, are substantially electrically isolated so that the dissipated charge from the glass envelope 11 accumulates in members 23 and 25. Members 23 and 25 are desirably sufficiently conductive and of sufficient capacitance so that the electrical potential associated with the accumulated charge in the members 23 and 25 does not exceed a suitable upper limit. After a coating operation and before another coating operation, the electrostatic charge accumulated on the members 23 and 25 is dissipated by grounding the members 23 and 25. To achieve the desirable electric field conducive for an adherent and uniform coating, it is desirable that the members 23 and 25 have an initial low electric charge, accumulate charge during the coating operation, and have the accumulated charge be dissipated prior to the next coating operation.

So as to provide the proper temperature control of the glass envelope 11, a plurality of resistive heater elements 31 are embedded in each of the electrically conductive charge retaining members 23 and 25. The heating capacity is preferably sufficient to heat the electrically conductive charge retaining members 23 and 25 to a maximum temperature of about 350° C. to 400° C. in the presence of cooling due to natural convection.

The holder 21 includes a gripper 41 which may be pneumatically actuated to close the electrically conductive charge retaining members 23 and 25 around the glass envelope 11 as illustrated in FIG. 3. The gripper 41 comprises outwardly extending members or fingers 33 and 35 being connected to electrically conductive charge retaining members 23 and 25. Preferably the fingers 33 and 35 are constructed of an electrically insulating material with a dielectric strength of at least 300 V/mil, a thermal expansion coefficient of less than 7E-5/K, and have a maximum use temperature of at least 250° C.

Prior to the coating process, both the glass envelope 11 and the electrically conductive charge retaining members 23 and 25 are preheated. A desired preheat temperature of the members 23 and 25 may be achieved by adjusting the voltage to the heaters 31. The glass envelope 11 may be preheated by any suitable method. Preferably the desired temperature of the glass envelope 11 is maintained during the electrostatic coating operation by adjusting the preheat temperature of said electrically conductive charge retaining members 23 and 25 and the degree of preheat of the glass envelope 11.

The electrically conductive charge retaining members 23 and 25 are electrically isolated prior to enclosing the glass envelope 11. During the electrostatic phosphor coating process, the electrically conductive charge retaining members 23 and 25 accumulate electrical charge from the phosphor particles being depositing on the glass envelope 11. After the electrostatic coating process is completed, the electrically conductive charge retaining members 23 and 25 are moved to an open position and the accumulated charge on the electrically conductive charge retaining members 23 and 25 is discharged.

During the coating process, a high voltage coating probe traverses up and down the interior of the glass envelope 11 distributing charged phosphor particles. The charge on the phosphor particles is transferred to the glass envelope 11 and the adjacent surfaces of the electrically conductive charge retaining members 23 and 25. The electric field strength is controlled by changing the coating probe potential and by controlling the temperature of the electrically conductive charge retaining members 23 and 25. The latter is accomplished by changing the voltage to the heaters 31 embedded in the electrically conductive charge retaining members 23 and 25. Also, the electric field strength is controlled by optimizing the mass of the electrically conductive charge retaining members 23 and 25. The mass of electrically conductive charge retaining members 23 and 25 is changed by removing or adding material. The electric field configuration is controlled by the design of the internal geometry of the said electrically conductive charge retaining members 23 and 25.

One optimization of the internal geometry of the electrically conductive charge retaining members 23 and 25 comprises the presence of a raised portion 39 which fits in the narrow space between the legs 13 and 15 of the twin tube 11 and also touches the outside of the lower portion of the bend area of twin tube 11.

DETAILED EXAMPLE

The invention discussed here is particularly directed to the electrostatic coating of an asymmetrical glass substrate in general, and a 13 W TT (twin tube) compact fluorescent lamp glass in particular. It is important to note that this invention is also applicable to any other size of compact fluorescent glass.

FIG. 1 and FIG. 2 show a typical 13 W TT glass. The TT glass has a rather narrow diameter. The 0375" internal diameter (ID) of this glass is only about 25% to 37.5% of that for typical symmetrical linear fluorescent lamp glass whose ID varies from about 1" to 1.5". Unlike the latter glass shapes where the average distance between the charging electrodes on the probe and the glass is much larger, the corresponding distance for the 13 W TT case is only about 0.1875" or about half the ID of the glass. Alignment of the coating probe within the glass, to prevent scraping of the coating by the probe, becomes much more critical for the narrow ID TT glass than for the larger glass.

FIG. 3 and FIG. 4 show the key features of the preferred embodiments. The electrically conductive charge retaining members or blocks 23 and 25 are a mirror image pair of cast-iron blocks with parallel grooves on the inside to accept the 13 W TT glass. Each groove has a raised portion 39 or ridge which fits in the narrow space between the two legs of the TT 11. The top of the ridge 39 also touches the outside of the lower portion of the bend area 17 of the glass 11. The overall dimensions of each block are about 5.875"×1.785"×0.94". The groove starts about 0.215" from the top of each block. Each of the blocks 23 and 25 has five holes drilled in it to accept five cylindrical resistive heating elements each of which can produce a maximum of 120 W at 115 V. The maximum block temperature that can be achieved by the heaters in the presence of cooling due to natural convection, is about 350° C. to 400° C. The heaters are about 0.25" in diameter and span 1.5" of the width of the blocks.

The blocks 23 and 25 are connected through fingers 33 and 35 to a pneumatically actuated gripper 41, which when activated closes the blocks around the TT glass 11. The TT glass is placed in a suitable holder to keep it upright and facilitate the motion of the blocks 23 and 25 around the glass 11. The open position of the gripper is shown in FIG. 4. The closed position is shown in FIG. 3. When the blocks are closed around the TT glass 11, about 0.5" of the glass length protrudes from the bottom of the blocks 23 and 25.

The fingers 33 and 35 are constructed of a material with suitable thermal and electrical characteristics. In particular, Ryton IPC-171E compression molded compound is used. This is a poly-phenylene sulfide resin impregnated with glass fiber and other modifiers. This particular material was chosen for its excellent electrical and thermal properties. It also exhibits very good machinability. It has a dielectric strength of 490 V/mil, a thermal expansion coefficient of 5.4 E-5/K and a high temperature use limit of about 315° C.

The length of the fingers 33 and 35 are an important parameter in the overall design since it is necessary to prevent a discharge between the blocks 23 and 25 and the gripper 41 when the high voltage probe enters the TT glass 11 enclosed by the blocks 23 and 25. A high dielectric strength of the finger material allows a shorter finger to be used, which makes the design much more compact. In addition, the proximity of the fingers 33 and 35 to the blocks 23 and 25 requires that the fingers be able to withstand some temperature. Furthermore, it helps if the coefficients of thermal expansion of the block material and the finger are not greatly different. Ryton IPC-171E is not the only material that may be used for the construction of the finger. Any other material with a dielectric strength of at least 300 V/mil, an expansion coefficient preferably less than 7E-5/K and a maximum use temperature of 250° C. or higher may be used.

The process of electrostatic coating of phosphor on 13 W TT glass 11 using the invention stated above is now described: A TT 11 preheated to about 200° C. is transferred by a suitable device to a coating station. The cast iron blocks 23 and 25 are preheated to about 50° C. by setting the voltage to the heating elements at about 28 V. The voltage to the heaters in the block is then disconnected by some suitable means, following which the pneumatic gripper 41 is actuated causing the blocks 23 and 25 to enclose the preheated TT glass 11. The heat transfer between the blocks 23 and 25 and the TT glass 11 is such that the temperature of the TT glass 11 is maintained at an optimum level during the electrostatic coating cycle. The optimum temperature range for the glass 11 is between 150° C. and 200° C.

A single phosphor or a phosphor blend is transported in an air stream through a plastic tube to a commercial high voltage gun with a suitable coating probe which is moved by some suitable means into and out of a designated first leg of the TT glass 11. The voltage at the tips of the charging electrodes on the coating probe, when the probe enters the TT leg, is about 60 to 65 kV. The blocks 23 and 25 charge up to about 40 to 45 kV in the presence of the probe. This causes a net driving force of about 20 to 25 kV, which is responsible for the establishment of an electric field. The phosphor particles charged in the corona around the probe tips migrate in this electric field towards the glass substrate. This leads to a coating of phosphor in the first leg of the TT 11 and a portion of the bend area 17.

After the first leg is coated, the pneumatic gripper 41 is deactivated causing the blocks 23 and 25 to expose the partially coated TT glass 11. The blocks 23 and 25 are now grounded by contacting them with a ground potential copper strip. This dissipates the charge accumulated on them during the coating of the first leg of the TT glass 11. At this time, the TT glass 11 is repositioned by suitable means such that the coating probe may now enter the second leg of the glass 11. The pair of blocks 23 and 25 is repositioned and the gripper 41 activated so that the TT 11 is again held in the grooves of the blocks 23 and 25. Finally, the coating probe moves up and down the second leg of the of the TT 11 leading to a phosphor coating in this leg and the remaining portion of the bend area 17.

After the coating probe has emerged from the second leg of the TT 11, the gripper 41 is deactivated thereby releasing the completely coated TT from the blocks 23 and 25. The coated TT is transferred to a thermal treatment station where the coated TT is heated by some suitable means up to about 400° C. to 450° C. so as to enhance the bond between the phosphor and the glass.

Phosphors coated by this electrostatic process on TT glass 11 may include one or more of the following types: cool white; yttrium oxide doped with europium; cerium aluminate doped with cerium and terbium; barium magnesium aluminate doped with europium; lanthanum phosphate doped with cerium, terbium; zinc silicate doped with manganese; strontium phosphate family of phosphors and any of these or other phosphors with surface treatments.

It has been stated before that the blocks 23 and 25 get charged during the coating step to a certain potential. A certain quantity of electric charge, which accumulates in the blocks 23 and 25 during the coating period, is associated with this potential. This quantity of accumulated charge is discharged by grounding the blocks 23 and 25 at the end of coating of each leg of the TT. An estimate of the theoretical maximum charge that can be collected by the blocks 23 and 25 is now made.

$$(q/m)_{max}=(3\epsilon_o BE)/(\rho r) \quad (1)$$

Equation (1) gives the maximum charge to mass ratio for an isolated and electrically insulating particle. It is called the Pauthenier limit and a reference for this relation may be found in Hughes, Journal of Electrostatics, 23, 3(1983). In Equation (1), $\epsilon_o$ is the permittivity of free space =8.854E-12 F/m, E is the electric field, $\rho$ is the particle density and r is its radius. B is a function of the relative permittivity, $\epsilon_r$, of the particle and is given by the relation, $$B=1+2(\epsilon_r-1)/(\epsilon_r+1) \quad (2)$$

It is clear from Equation (2) that the maximum value of B is 3 and this happens when $\epsilon_r$ is significantly greater than unity.

For the conditions of coating as discussed in this invention E is about 20 kV/0.1875" or 4.2 E6 V/m. For commercial phosphors of interest, $\epsilon_r$ varies from about 6 to 10. A mean value of 8 will be used which results in a value of B from Equation (2) as 2.55. A phosphor density of 5.1 g/cc, characteristic of yttrium oxide phosphors, and a phosphor particle radius of 3 $\mu$m will be used. It follows from Equation (1) that for the conditions of this experiment $(q/m)_{max}$ is about 19 $\mu$C/g. A typical q/m value actually achieved by phosphors charged in coronas varies from about 1 to 3 $\mu$C/g.

The average rate of phosphor being fed to the coating probe is about 0.04 g/s. This implies that the maximum possible rate of charge transfer (or current flow) to the blocks 23 and 25, due to the deposition of the charged phosphor particles on the glass, is about 19 $\mu$C/g$\times$0.04 g/s or 0.76 $\mu$A. It is well established (Hughes ibid) that in corona charging systems only about 0.5% of the available ions attach themselves to the particles, while the remaining 99.5% remains as free ions which alight independently on the substrate. Thus, the maximum possible rate of overall charge transfer to the blocks 23 and 25 is about 0.76 $\mu$A/0.005 or 150 $\mu$A.

The mass of phosphor coating needed on larger sized TT glass 11 (used to make higher wattage compact fluorescent lamps) will be greater than that for the 13 W TT case. It is necessary that the electrical characteristics of the blocks 23 and 25 for larger sized TT coatings be such that the potential reached by the blocks 23 and 25 during the coating cycle does not exceed about 40 to 45 kV for a coating probe potential of about 60 to 65 kV. This ensures that there is at least a 20 kV net driving force for an electric field in which the charged phosphor particles can migrate to the wall of the TT glass 11. Too low an electric field strength will produce poor coating quality as has been explained earlier.

The potential reached by the blocks 23 and 25 depends on the charge transferred to the blocks 23 and 25 by the particles and the free ions. The heaviest coating of phosphor expected in a TT will be about a gram. It follows from the calculations outlined in a previous paragraph that this amount of powder will have a maximum charge of about 19 $\mu$C. Taking into account the fact that this is only about 0.5% of the total charge transferred to the blocks 23 and 25, the maximum possible charge transferred to the blocks 23 and 25 in the case of the largest TT glass 11 is about 19/0.005 or 3800 $\mu$C or 3.8 mC. In other words, the electrical characteristics of the pair of blocks 23 and 25 for the electrostatic coating of the largest commercial TT glass 11 should be such that the potential of the blocks 23 and 25 does not exceed 40 to 45 kV for a maximum charge accumulation of about 3.8 mC in the blocks 23 and 25. For coating of the 13 W TT, the maximum possible charge accumulation is about 40% (since powder weight is about 0.4 g) of 3.8 mC or 1.5 mC. It follows from the reasoning presented in this section that a pair of blocks 23 and 25 which meets the voltage-charge characteristic requirements for the largest size TT will also work for smaller sized TT glass.

The magnitude of the electric field for the deposition of the phosphors on the TT glass 11 is determined by the net driving force which depends on the difference in potential between the blocks 23 and 25 and the coating probe. While the magnitude of the electric field can be changed by altering the coating probe potential, the former is preferably changed by altering the potential reached by the blocks 23 and 25. This is possible by either altering the amount of electrical charge that is transferred to the blocks 23 and 25 or by changing the mass of the blocks 23 and 25 (by shaving off a section for example). The former is achieved by altering the block temperature which influences the glass temperature and subsequently its ionic conductivity. Too high an ionic conductivity may enhance the charge transfer to the blocks 23 and 25, raising their potential and decreasing the net electric field available for phosphor deposition. As regards the option of changing the mass of the blocks 23 and 25, a larger block mass will result in a lower block potential and a higher electric field for the same amount of charge accumulation.

The invention also makes it possible to apply an optimum configuration of the electric field for the deposition of phosphors on the asymmetrical TT glass 11. In particular, it is not possible to deposit a good quality coating on the lower portion of the bend area 17 of the TT glass 11 if the blocks 23 and 25 are not present around the glass. In the absence of the blocks 23 and 25, the coating on the lower portion of the bend area 17 is either very light or is characterized by voids. When the blocks 23 and 25 enclose the TT, the ridge 39 on each of the cast iron blocks 23 and 25 contacts the outside of the lower portion of the bend area 17, helping to provide a local electrical field for the deposition of the particles in that region.

The temperature of the TT 11 during the coating cycle is easily controlled with significant flexibility by changing the temperature of the blocks 23 and 25 relative to that of the preheated TT 11. Changing the block temperature is accomplished by altering the voltage setting to the heating elements 31 of the blocks 23 and 25. Since the entire effective surface of the TT 11 is enclosed by the blocks 23 and 25, conformal heating is also possible leading to excellent uniformity of heating of the asymmetrical TT.

In summary, this invention describes a means for providing an optimum electric field configuration and strength for the electrostatic coating of phosphors on asymmetrical glass substrates in general, and compact fluorescent lamp glass in particular, while maintaining the temperature of the glass substrate within an optimum range by means of conformal heating.

According to the preferred process of the present invention, the electrically conductive charge retaining members and gripper combination of the present invention is desirably utilized in the process disclosed in U.S. patent application Ser. No. 07/895,762 filed Jun. 9, 1992 and entitled Method of Coating Phosphors on Fluorescent Lamp Glass by Dutta et al. The specification of this application is incorporated into the present specification by reference. According to Ser. No. 07/895,762, phosphor particles are pretreated by depositing a polymer on the surface of the phosphor and, optionally, the interior surface of the glass. The deposition of polymer to the phosphor particles enhances the electrostatic coating process by improving the flowability of the phosphor, increasing the adhesion of the coating, raising the upper bound of the coating weight and improving the cosmetics of the coated lamp.

The polymer is a type having a decomposition temperature and which is transformable from a non-adhering state to an adhering state. Inorganic additives are often present in polymers. In the present case, such additives should not adversely affect lamp performance. For example, it is known that silica reacts adversely with mercury in low pressure discharge lamps. Preferably, the concentration of silicates in the coating of the finished lamp should not exceed 500 parts per million.

Then the phosphor particles comprising polymer are deposited on the fluorescent lamp glass. During this step, the polymer is in an adhering state for retaining the phosphor particles on the fluorescent glass to form a coated fluorescent glass.

During the deposition of the phosphor on the inner surface of the glass, the glass is maintained at an appropriate first temperature, such as by using an electrically heated mold, while the phosphor particles coat the inner surface. Preferably the mold is preheated to assure that the initial deposition of phosphor particles is at the correct temperature.

During the period the glass is being electrostatically coated, the mold preferably remains electrically isolated to reduce the magnitude of the charge flow or current to ground. If the probe current exceeds a certain value, the electrical safety circuit of the probe becomes energized and drops the probe voltage to compensate for the large current. A reduction in the probe voltage is not desirable because it reduces the charge transferred from the probe corona to the phosphor particles comprising polymer. Reduction in the charging of the particles affects the quality of the coating. Any charge build up on the coating, after the phosphor particles comprising polymer are deposited on the glass, is dissipated by grounding through a conductive path. This helps reduce the porosity of the coating by eliminating charge induced repulsion among the particles. Exposing the phosphor coating on the glass to a conductive fluid such as steam to dissipate electrostatic charges is preferred.

Next, the coated fluorescent glass is heated to a temperature above the decomposition temperature of the polymer for removing the polymer to form a coating of the phosphor particles on the fluorescent lamp glass which is devoid of organic compounds. The heating also desirably removes any water vapor which can be deleterious to the operation of a completed fluorescent lamp.

The process is used to produce a fluorescent lamp containing a phosphor excitable to fluorescence. A fluorescent lamp comprises a tubular, hermetically sealed, glass envelope. Electrodes are sealed in the ends of envelope. Suitable terminals are connected to the respective electrodes and project from envelope. The electrodes extend through glass presses in mount stems to the terminals. The interior of the tube is filled with an inert gas such as argon or a mixture of argon and krypton at a low pressure, for example 2 torr, and a small quantity of mercury, at least enough to provide a low vapor pressure during operation. An arc generating and sustaining medium such as one or more inert gases and mercury is included within the envelope so that ultraviolet radiation is produced in the interior of the glass envelope during lamp operation. A phosphor coating on the interior surface of the glass envelope converts the emitted ultraviolet radiation to visible illumination having a white color.

What is claimed is:

1. A method for coating electrically charged phosphor particles on an interior surface of an asymmetric fluorescent glass envelope by providing an electric field having a desirable configuration and strength while limiting electric current and maintaining the temperature of the glass envelope at a temperature conducive for coating comprising enclosing and contacting at least a portion of a fluorescent glass envelope with at least one electrically conductive charge retaining member, said charge retaining member being maintained at a suitable temperature for coating, issuing a stream of electrically charged phosphor particles into the interior of said glass envelope by transporting said phosphor particles in a carrier gas stream through a high voltage probe generated corona, said electrically conductive charge retaining member being at a different electrical potential than said high voltage probe for attracting said charged phosphor particles to said interior surface of said glass envelope, maintaining contact between said glass envelope and said electrically conductive charge retaining member for dissipating electric charge from said phosphor particles to said charge retaining member, maintaining said electrically conductive charge retaining member substantially electrically isolated wherein electrical charge in or on said member increases during electrostatic coating causing the electric potential of said member to increase whereby electric current associated with the high voltage probe due to said transfer of charge to said charge retaining member is limited, and discharging said electric charge from said member after said coating.

2. A method in accordance with claim 1 wherein said electrically conductive charge retaining member comprises at least a pair of electrically conductive charge retaining members having opposing and facing surfaces for substantially enclosing said fluorescent glass envelope and said fluorescent glass envelope has asymmetrically shaped outer surface and each of said opposing surfaces includes a respective depression, each depression substantially matching a portion of said asymmetrically shaped surface for substantially entirely enclosing said fluorescent glass envelope, said opposing surfaces having at least one point for contacting said glass envelope.

3. A method in accordance with claim 2 wherein each of said electrically conductive charge retaining members have embedded resistive heating elements of sufficient capacity to heat said electrically conductive charge retaining members to a maximum temperature about 350° C. to 400° C. in the presence of cooling due to natural convection.

4. A method in accordance with claim 2 wherein said glass envelope is enclosed by pneumatically actuating a gripper having a pair of outwardly extending members movable from an open position to a closed position, each of said electrically conductive charge retaining members being operably connected to said outwardly extending members for enclosing said electrically conductive charge retaining members around said glass envelope.

5. A method in accordance with claim 4 wherein said outwardly extending members comprise an electrically insulating material with a dielectric strength of at least 300 V/mil.

6. A method in accordance with claim 4 wherein said outwardly extending members comprise a material with a thermal expansion coefficient of less than 7E-5/K.

7. A method in accordance with claim 4 wherein the outwardly extending members comprise a material with a maximum use temperature of at least 250° C.

8. A method in accordance with claim 1 comprising preheating said glass envelope prior to enclosure.

9. A method in accordance with claim 8 wherein said glass envelope is preheated to about 200° C. prior to enclosure.

10. A method in accordance with claim 2 wherein said electrically conductive charge retaining members are preheated to a desired temperature prior to enclosure.

11. A method in accordance with claim 10 wherein said electrically conductive charge retaining members are preheated to a temperature of about 50° C.

12. A method in accordance with claim 11 comprising controlling said temperature of said electrically conductive charge retaining members by adjusting the voltage to the heaters embedded in the said electrically conductive charge retaining members.

13. A method in accordance with claim 2 wherein said glass envelope is maintained at a desired temperature during said electrostatic coating by adjusting the temperature of said electrically conductive charge retaining members and said temperature of said glass envelope during said preheating.

14. A method in accordance with claim 13 wherein said desired temperature of said glass envelope is between 150° C. and 200° C.

15. A method in accordance with claim 2 wherein said electrically conductive charge retaining members are electrically isolated prior to enclosing said glass envelope.

16. A method in accordance with claim 2 wherein said electrically conductive charge retaining members accumulate electrical charge from the phosphor particles being depositing on said glass envelope.

17. A method in accordance with claim 16 wherein the accumulated charge on the said electrically conductive charge retaining members is discharged after electrostatic coating.

18. A method in accordance with claim 2 wherein said phosphors comprise cool white; yttrium oxide doped with europium; cerium aluminate doped with cerium and terbium; barium magnesium aluminate doped with europium; lanthanum phosphate doped with cerium, terbium; zinc silicate doped with manganese; strontium phosphate family of phosphors and any of these or other phosphors with surface treatments.

19. A method in accordance with claim 2 wherein said electrically conductive charge retaining members have electrical characteristics wherein the potential does not exceed 40 to 45 kV for a maximum charge accumulation of 3.8 mC in said electrically conductive charge retaining members.

20. A method in accordance with claim 2 wherein a coating probe traverses an interior portion of said glass envelope after enclosure by said electrically conductive charge retaining members.

21. A method in accordance with claim 20 wherein the electric field strength is desirably selected by changing the coating probe potential.

22. A method in accordance with claim 2 wherein the electric field strength is controlled by changing the temperature of said electrically conductive charge retaining members.

23. A method in accordance with claim 22 wherein said temperature of said electrically conductive charge retaining members is controlled by changing the voltage to the heaters embedded in said electrically conductive charge retaining members.

24. A method in accordance with claim 2 wherein the electric field strength is optimized by optimizing the mass of said electrically conductive charge retaining members.

25. A method in accordance with claim 24 wherein the mass of said electrically conductive charge retaining members mass is optimized by removing or adding to the mass of said electrically conductive charge retaining members.

26. A method in accordance with claim 2 wherein the electric field configuration is optimized by optimizing the design of the internal geometry of the said electrically conductive charge retaining members.

27. A method in accordance with claim 26 wherein the internal geometry of the said electrically conductive charge retaining members is optimized by the presence of a groove which fits in the narrow space between the legs of glass envelope and also touches the outside of the lower portion of the bend area of said glass envelope.

28. A method in accordance with claim 2 wherein said glass envelope is uniformly heated by enclosing all of the effective surface of the glass envelope within said electrically conductive charge retaining members.

29. A method in accordance with claim 2 wherein said glass envelope comprises a U-shaped twin tube having leg portions and each of said electrically conductive charge retaining members has a groove which fits in the narrow space between said leg portions and contacts the outside of the lower portion of the bend area of the twin tube glass.

* * * * *